US008756746B2

(12) United States Patent
Policicchio

(10) Patent No.: US 8,756,746 B2
(45) Date of Patent: Jun. 24, 2014

(54) CLEANING ARTICLE WITH ELASTICALLY CONTRACTED SHEET

(75) Inventor: Nicola John Policicchio, Mason, OH (US)

(73) Assignee: The Procter & Gamble, Cincinnati, OH (US)

( * ) Notice: Subject to any disclaimer, the term of this patent is extended or adjusted under 35 U.S.C. 154(b) by 168 days.

(21) Appl. No.: 13/416,486

(22) Filed: Mar. 9, 2012

(65) Prior Publication Data

US 2013/0232714 A1 Sep. 12, 2013

(51) Int. Cl.
*A47L 13/16* (2006.01)

(52) U.S. Cl.
USPC ..... 15/229.3; 15/226; 15/229.4

(58) Field of Classification Search
USPC ..... 15/229.3, 229.4, 229.7, 229.8, 226
See application file for complete search history.

(56) References Cited

U.S. PATENT DOCUMENTS

| | | | |
|---|---|---|---|
| 823,725 | A | 6/1906 | Hayden et al. |
| 3,813,801 | A | 6/1974 | Vander Schaaf |
| 4,145,757 | A | 3/1979 | Bonnie |
| 4,506,404 | A | 3/1985 | Clay |
| 5,536,555 | A | 7/1996 | Zelazoski et al. |
| 5,953,784 | A | 9/1999 | Suzuki et al. |
| 6,513,184 | B1 | 2/2003 | Brown et al. |
| 6,550,092 | B1 | 4/2003 | Brown et al. |
| 6,773,424 | B2 | 8/2004 | Heyrman et al. |
| 6,813,801 | B2 | 11/2004 | Tanaka et al. |
| 6,963,591 | B2 | 11/2005 | Tulloch et al. |
| 6,984,615 | B2 | 1/2006 | Kenmechi et al. |
| 7,228,587 | B2 | 6/2007 | Tanaka et al. |
| 7,231,685 | B2 | 6/2007 | Tanaka et al. |
| 7,234,193 | B2 | 6/2007 | Tanaka et al. |
| 7,234,914 | B2 | 6/2007 | Usab et al. |
| 7,237,296 | B2 | 7/2007 | Tanaka et al. |
| 7,237,297 | B2 | 7/2007 | Tanaka et al. |
| 7,243,391 | B2 | 7/2007 | Tanaka et al. |
| 7,251,851 | B2 | 8/2007 | Lin et al. |
| 7,302,729 | B2 | 12/2007 | Tanaka et al. |
| 7,302,730 | B2 | 12/2007 | Tanaka et al. |
| 7,334,287 | B2 | 2/2008 | Tanaka et al. |
| 7,435,243 | B2 | 10/2008 | Miyamoto |
| 7,566,671 | B2 | 7/2009 | Hoadley et al. |
| 7,918,839 | B2 | 4/2011 | Ehrnsperger et al. |
| 2004/0016074 | A1 | 1/2004 | Tanaka |

(Continued)

FOREIGN PATENT DOCUMENTS

| | | | | |
|---|---|---|---|---|
| EP | 0945251 | A1 | 9/1999 | |
| JP | 2011104111 | A * | 6/2011 | ..... A47L 13/16 |

OTHER PUBLICATIONS

JP2011104111A (Abstract), 2011.*
U.S. Appl. No. 13/416,334, filed Mar. 9, 2012, Policicchio.

(Continued)

*Primary Examiner* — Mark Spisich
*Assistant Examiner* — Andrew A Horton
(74) *Attorney, Agent, or Firm* — Larry L. Huston; Steven W. Miller

(57) ABSTRACT

A cleaning article optionally removably attachable to a handle and comprising tow fibers and at least one sheet joined together in a layered construction. The cleaning article is generally planar. The sheet is elastically contracted. The sheet may be elastically contracted by heat shrinkable material, by elastic strands and/or may be elastomeric. This arrangement allows the sheet to entangle and thereby fluff the tow fibers. Such fluffing is believed to improve cleaning performance.

20 Claims, 3 Drawing Sheets

(56) References Cited

U.S. PATENT DOCUMENTS

| | | | | |
|---|---|---|---|---|
| 2005/0198757 | A1 | 9/2005 | Gavney, Jr. et al. | |
| 2006/0016036 | A1* | 1/2006 | Tanaka et al. | 15/226 |
| 2006/0101601 | A1 | 5/2006 | Fujiwara | |
| 2007/0084006 | A1* | 4/2007 | Policicchio | 15/226 |
| 2010/0319152 | A1* | 12/2010 | Prizepasniak | 15/210.1 |
| 2011/0131746 | A1 | 6/2011 | Policicchio et al. | |
| 2011/0154598 | A1 | 6/2011 | Yamada | |

OTHER PUBLICATIONS

U.S. Appl. No. 13/416,526, filed Mar. 9, 2012, Cooper.
U.S. Appl. No. 13/416,420, filed Mar. 9, 2012, Policicchio.
International Search Report Dated May 23, 2013; 11 pages.

* cited by examiner

CLEANING ARTICLE WITH ELASTICALLY CONTRACTED SHEET

FIELD OF THE INVENTION

The present invention relates to cleaning articles, and more particularly to cleaning articles comprising tow fibers and the like.

BACKGROUND OF THE INVENTION

Various cleaning articles have been created for dusting and light cleaning. For example, cloth rags and paper towels used dry or wetted with polishing and cleaning compositions have been used on relatively flat surfaces. But, rags and paper towels are problematic for reasons such as hygiene (the user's hand may touch chemicals, dirt or the surface during cleaning), reach (it may be difficult to insert the user's hand with the rag or paper towel into hard-to-reach places) and inconvenience (cleaning between closely-spaced articles typically requires moving the articles).

To overcome the problems associated with using rags and paper towels, various dust gathering devices having feathers, lamb's wool, and synthetic fiber brushes have been utilized for more than a century, as illustrated by U.S. Pat. No. 823,725 issued in 1906 to Hayden. Such dust gathering devices can be expensive to manufacture, and as such are designed to be cleaned and reused. One problem associated with a reusable dust gathering device is that such dust gathering devices may not hold or trap dust very well. Soiled, reusable devices are typically cleaned via shaking or through other mechanical agitation. This process is not entirely satisfactory as it requires an extra step during, interrupting and/or following the cleaning process. Furthermore, the attempted restoration of the device may not be successful, allowing redeposition of the previously collected dust.

To address the problems experienced with reusable dust gathering devices, disposable dust gathering devices have been developed which have limited re-usability. These disposable dust gathering devices may include brush portions made of synthetic fiber bundles, called tow fibers, attached to a sheet as shown in 2010/0319152. Or the tow fibers may be attached to a plate as shown in U.S. Pat. No. 4,145,787. The disposable cleaning article may be used for one job (several square meters of surface) and discarded, or may be restored and re-used for more jobs, then discarded. Traditional cleaning articles including feather dusters, cloths, string mops, strip mops and the like, are not disposable for purposes of this invention.

Such devices may be made, for example, according to U.S. Pat. Nos. 6,813,801; 6,968,591; 6,984,615; 7,228,587; 7,231,685; 7,234,193; 7,234,914; 7,237,296; 7,237,297; 7,243,391; 7,302,729; 7,302,730; and/or 7,334,287 (having a common related application). The patents in this linage have a common feature—strips laterally extending from both sides of a generally planar article. The strips serve the purpose of increasing surface area of intermediate tow fibers by promoting deformation of the tow fibers out of the plane of the article. This approach has the attendant problem that excessive material is used for the strips. If the strips have the same length, taken from the longitudinal axis, as the tow fibers, the strips can interfere with the tow fibers fully contacting the target surface.

Another problem with a cleaning article comprising strips is that such cleaning articles are typically packaged in a flat state. To get optimum performance, a user should pre-fluff the cleaning article prior to use. Even with instructions, many users simply do not understand how to correctly perform this step. Some users do not read the instructions and entirely skip this step. Furthermore, the strips can be partially joined together due to improper cutting during manufacture, making the fluffing insufficient or more difficult. The problem of strips in such cleaning articles is exacerbated in U.S. Pat. No. 5,953,784 which teaches strips extending not only from both sides of the cloth, but also from the front.

One attempt to overcome this problem is found in U.S. Pat. No. 7,566,671 which does not use laterally extending strips. However, this attempt has the drawback that the cleaning implement thereof only cleans on one side of the implement—not both sides as taught by the lineage of U.S. Pat. No. 6,813,801.

An attempt to overcome the single-sided cleaning disadvantage of the aforementioned U.S. Pat. No. 7,566,671 is found in U.S. Pat. No. 7,251,851 which teaches a spiral duster. However, this approach starts with a construction similar to that of the aforementioned U.S. Pat. No. 6,813,801 lineage and U.S. Pat. No. 823,725—leading the intended solution back to the same approach which started the problem 100 years ago.

Thus, there is a need for a cleaning article which does not require gather strips. Such cleaning article may further provide for advantageous use of the tow fibers to gather and retain dust and may also allow the user to minimize or eliminate the often overlooked or improperly performed fluffing step.

SUMMARY OF THE INVENTION

The invention comprises a cleaning article having a longitudinal axis therethrough. The cleaning article comprises at least one layer of tow fibers. The tow fibers extend laterally outward from proximal ends juxtaposed with the longitudinal axis to distal ends laterally remote therefrom. The tow fiber layer has first and second opposed faces. A generally planar sheet is disposed on the first face of the at least one layer of tow fibers. The sheet is elastically contracted to have a width less than the width of the tow fibers.

DETAILED DESCRIPTION OF THE INVENTION

Figure 1:
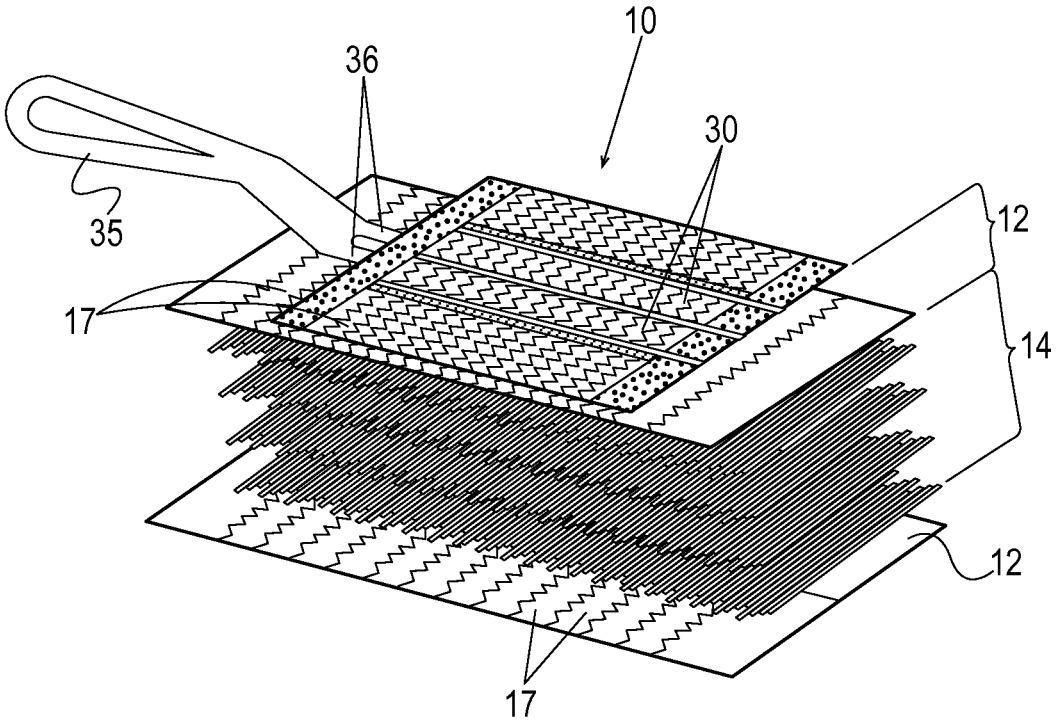
PRIOR ART Fig. 1
FIG. 1 is a schematic exploded perspective view of a cleaning article according to the prior art and having strips.

Referring to FIG. 1, the cleaning article 10 may be generally elongate, having a longitudinal axis L, although other shapes are contemplated and feasible. The cleaning article 10 may be removably attachable to a handle 35 and/or may be used without a handle 35. A suitable handle 35 is disclosed in commonly assigned U.S. application Ser. No. 12/613,015 filed Nov. 5, 2009.

The z-direction of the cleaning article 10 is the direction perpendicular to the sheet 12 which is typically closest to the handle 35 (if present) of the cleaning article 10, the XY plane is defined as the plane defined by the sheet 12 and is typically perpendicular to the z-direction. The cleaning article 10 may have a longitudinal axis L and a transverse axis T orthogonal thereto. The cleaning article 10, and respective components thereof, may have two longitudinal edges parallel to the longitudinal axis L and two transverse edges parallel to the transverse axis T.

The length of the cleaning article 10, etc. is taken in the longitudinal direction. The width of the cleaning article 10 corresponds to the transverse direction perpendicular to the length direction and disposed within the plane of the sheet 12. The thickness is defined as the dimension in the z-direction. The length and width of the strips shown in the art are taken in the transverse and longitudinal directions, respectively.

The cleaning article 10 may be thought of as having two, three or more laminae joined in face-to-face relationship. The laminae may comprise a tow fiber lamina, intermediate two laminae of generally planar sheets 12. Alternatively, a single tow fiber layer 14 may be joined to a single generally planar sheet 12. The tow fiber layer 14 is shown to comprise four layers, although one of skill will understand from one to several tow fiber layers 14 are feasible and contemplated for use with the present invention. Likewise, one, two, three or more sheets 12 are feasible and contemplated for use with the present invention.

An attachment system may provide for removable attachment of the cleaning article 10 to a suitable and optional handle 35. The cleaning article 10 attachment system and optional complementary handle 35 attachment may comprise adhesive joining, cohesive joining, mechanical engagement, etc. One common attachment system comprises sleeves 30 into which the tines 36 of the handle 35 may be inserted. The sleeves 30 may be disposed on an outer lamina sheet 12.

The sheet 12 may have an outwardly facing preferential cleaning side and a second inwardly facing attachment side opposed thereto. The sheet 12 may comprise a nonwoven sheet 12. Suitable nonwovens may be made according to commonly assigned U.S. Pat. Nos. 6,383,431, 6,797,357; 6,936,330, D489,537 and/or D499,887. Likewise the sheet 12 of the present invention may comprise a similar nonwoven sheet 12.

Adjacent the sheet 12 may be a compressible and/or deformable second lamina of fibers. The second lamina may comprise tow fibers 14. The tow fiber lamina 14 may be joined to the sheet 12 in face-to-face relationship. The tow fiber lamina 14 may be suitable for directly contacting the target surface during cleaning.

The tow fibers 14 may be synthetic. As used herein "bundle fibers" and/or "tow" refer to fibers comprising synthetic polymers including polyester, polypropylene, polyethylene and cellulose materials including cellulose acetate and mixtures thereof manufactured wherein the individual fibers are relatively long strands manufactured in bundles. The bundle fibers may be defined as any fibers having distinct end points and at least about 1 cm in length. The cleaning article 10 of the present invention may further comprise an optional absorbent core (not shown).

The sheet 12, fibrous layer 14 and non-planar structure 16 may be joined together by thermal bonding, autogenous bonding, ultrasonic bonding, heat sealing, adhesive and/or other means known in the art. The sheet 12 may comprise two plies, joined together in face-to-face relationship. The sheet 12, fibrous layer 14 and non-planar structure 16 may be bonded in a pattern which provides a central spine 42 parallel the longitudinal axis L.

The bonding pattern joining the two plies may be provided in a pattern which provides a sleeve 30 complementary to and able to receive the tines 36 of the handle 35, if used with the cleaning article 10 of the present invention. Particularly, the bonding may be provided in a pattern which is generally longitudinally oriented, so that the tines may be inserted into the sleeve 30 created between adjacent bonds 38.

The joining of the tow fiber layer 14 and generally planar sheets 12 may be done with any combination of continuous bonds 38 and/or spot bonds 38, as known in the art. The bonds 38 may be used to create sleeves 30 for an attachment system as known in the art and discussed herein.

The bond pattern may provide a continuously bonded or discretely bonded central spine 42. Outboard of the central spine 42, the bond pattern may comprise one or more continuous or discontinuous bond sites 38. The space between the central spine 42 bond and the outboard bonds 38 may create a sleeve 30 for receiving a tine 36 of the optional handle 35. If desired, the sheet 12 may be shrunk/strained in the cross-direction. This process can provide rugosities 21 or wrinkles in sheet 12. The rugosities 21/wrinkles space apart the plies of sheet 12, allowing for easier insertion of the tines 36 into the sleeve 30, if so desired.

More particularly the cleaning article 10 comprises at least one layer 14 of tow fibers. The tow fibers extend transversely outward from proximal ends juxtaposed with the longitudinal axis L to distal ends transversely remote therefrom. The tow fiber layer 14 has first and second opposed faces. The second face extends outwardly.

A generally planar sheet 12 is disposed on the first face of the at least one layer of tow fibers. The sheet 12 has a first face joined to the first face of the layer of tow fibers and a second face opposed thereto. Again, the second face extends outwardly.

The cleaning article 10 according to the present invention for removable attachment to a handle 35 has a longitudinal axis L defining a longitudinal length. Again, the cleaning article 10 comprises at least one layer of tow fibers 14. The tow fibers extend transversely outward from proximal ends juxtaposed with the longitudinal axis L to distal ends laterally remote therefrom. The tow fiber layer 14 further has first and second opposed faces and defines a tow fiber width. The tow fiber width is the distance from the longitudinal axis L to the distal end of a particular tow fibers taken in a straight, planar and transverse direction. The tow fiber width may be straight or variable throughout the longitudinal length.

The cleaning article 10 further comprises a generally planar sheet 12 disposed on a first face of the at least one layer of tow fibers 14. The sheet 12 having a sheet 12 width taken in a straight, planar and transverse direction. The sheet 12 width is being predominantly less than the tow fiber width. The difference between sheet 12 width and tow fiber width varies along a predominant portion of the longitudinal length of the cleaning article 10. This geometry is referred to herein as differential overhang DO.

Of course such differential overhang DO is relevant throughout the longitudinal length where there is coincidence between the sheet 12 and layer of tow fibers 14 and is controlled by the longitudinally shorter of these components. By predominantly, it is meant that the sheet 12 width is less than the tow fiber width, throughout at least 50%, 75% or 100% of the longitudinal length of said sheet 12. However, a cleaning article 10 having a differential overhang DO throughout at least 10, 20, 30 or 40% of the longitudinal length is also contemplated.

Of course, if there are one or more sheets 12 interposed between plural layers of tow fibers 14, or vice versa, each sheet 12/tow fiber layer 14 will provide a different combination of sheet 12 width and tow fiber width. Each such combination will provide a respective differential overhang DO therebetween. The differential overhang DO may be the same or different, as desired. Conversely, in one embodiment, the cleaning article 10 may be symmetric about the longitudinal axis L. If so the differential overhang DO of the tow fibers over the edge of the sheet 12 will be the same on both sides of the longitudinal centerline.

Figure 2:
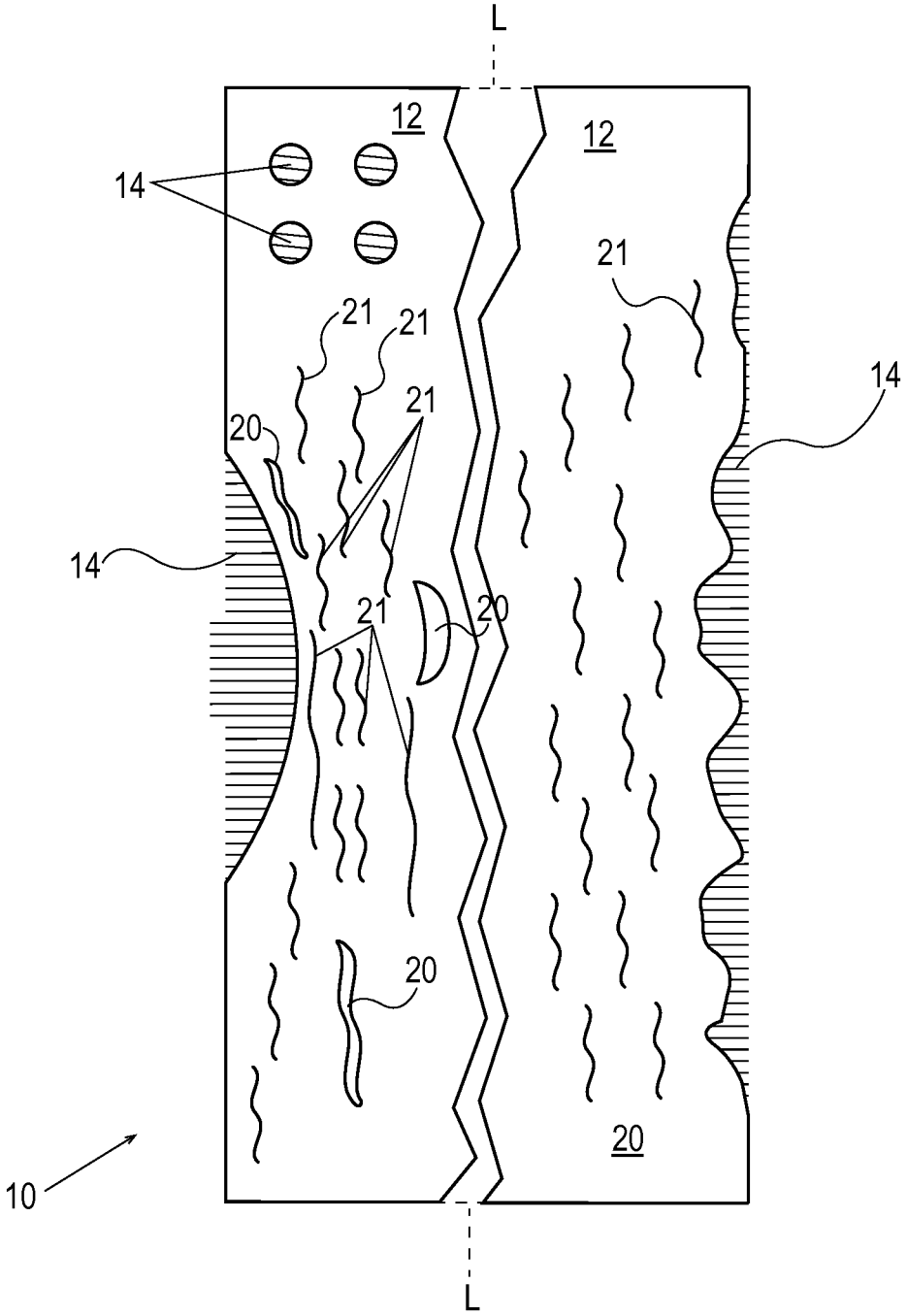
FIG. 2 is a broken top plan view of a cleaning article according to the present invention having an elastically contracted sheet, with a concave longitudinal edge, differential tow width and four round apertures on one side of the longitudinal axis.

Referring to FIG. 2, the sheet 12 may be elastically contracted to provide the differential overhang DO. The elastic contraction may be parallel to the transverse direction, partially parallel to the longitudinal axis L or diagonal thereto. If desired, the elastic 20 may be applied to the sheet 12 in a sinusoidal pattern, providing contraction in a primary direction and lesser contraction in a secondary direction. The elastic contraction may be greater in some areas of the sheet 12 and less in other areas of the sheet 12.

If the sheet 12 and layer of tow fibers are of constant width, then greater contraction will result in greater differential overhang DO. Thus, the amount of overhang of the tow fibers relative to the sheet 12 may vary throughout the longitudinal length of the cleaning article 10, or may be constant. The elastic contraction may provide for differential overhang DO throughout all or only a portion of the cleaning article 10.

If desired, the differential overhang DO may be greater at the front of the cleaning article 10, i.e. the part of the cleaning article 10 disposed away from the user when an optional handle 35 is inserted into the cleaning article 10. This arrangement prophetically provides more free tow fiber length to reach into tight places being cleaned.

Alternatively, the elastic contraction may be increased, and the amount of differential overhang DO likewise increase, as the transverse axis T is approached. This arrangement prophetically provides the benefit that increased cleaning may occur near the center of the cleaning article 10, keeping the ends free for reaching into/cleaning tight spaces.

If desired tow sheets 12 may be used with the cleaning article 10. The two sheets 12 may be of like or different width. Either or both such sheets 12 may have a width less than the width of the layer of tow fibers 14 when elastically contracted in the transverse direction. If such an embodiment is selected, the sheets 12 may have identical or different contractive configurations.

Either or both sheets 12 may be of constant or variable sheet 12 width. If a variable sheet 12 width is selected, the sheet 12 width may decrease as the transverse axis T is approached.

If desired, the elastic 20 may be disposed between the two sheets 12. For example, either or both sheets 12 may be sprayed with adhesive, such as a spiral adhesive. An elastic 20, such as an elastic strand 20, may be tensioned, then joined to the adhesive, prior to assembling the two sheets 12 in confronting relationship.

An elastic 20 may joined to the sheet 12 intermediate the ends of the sheet 12 or juxtaposed with the ends of the sheet 12. By intermediate it is meant that the elastic 20 may joined to the sheet 12 at any position between or coincident the longitudinal edges and/or transverse edges of the sheet 12 which allows an operative relationship between the sheet 12 and elastic 20. By operative relationship, it is meant that the elastic 20 contracts the sheet 12, causing the sheet 12 to extend outwardly from the plane of the tow fiber layer 14 or sheet 12.

Figure 3:
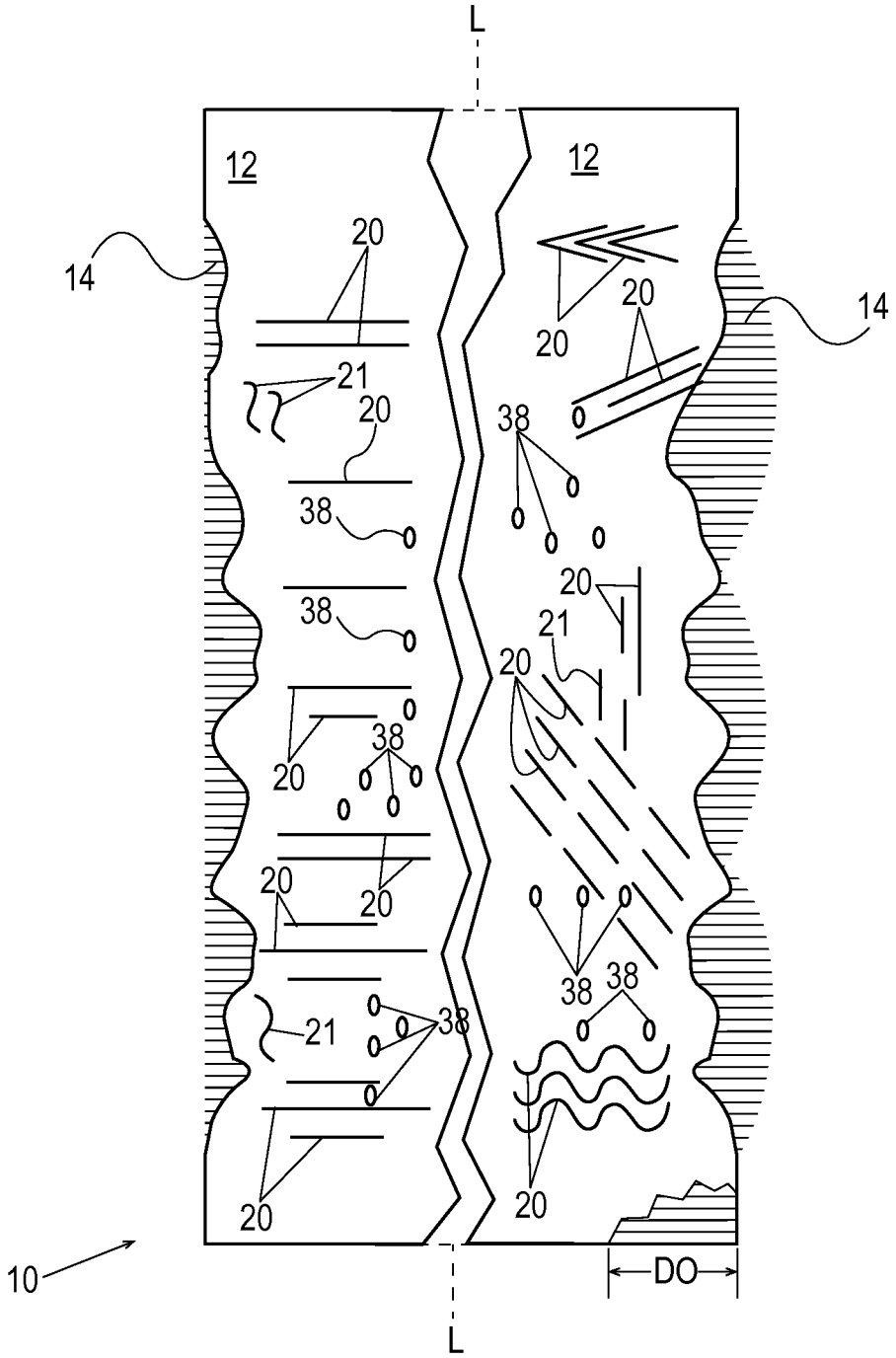
FIG. 3 is a broken top plan view of a cleaning shown partially in cutaway and having a sheet with plural elastic strands, and having constant tow width on one side of the longitudinal axis and differential tow width on the other side of the longitudinal axis.

Referring to FIG. 3, suitable elastics 20 may comprise an elastic strand 20, like a rubber band ranging from 0.5 mm to 15 mm. Suitable examples include Fulflex System 7000 available from Fulflex Inc. of Brattleboro, Vt. or Rubber 4141 Soft Stretch Elastic available from Risdon, Spartanburg S.C.

The elastic strands may also comprise an elastomer, such as LYCRA elastomer, available from EI DuPont de Nemours, Wilmington, Del. Individual elastic strands 20 may range from about 470-1500 decitex or about 620-1050 decitex. Other suitable materials are thermoplastic elastomers such as TEX 3CW15 available from Fulflex Inc.

The elastic strands 20 may be of like or different spring rates. It is prophetically believed the different spring rates may cause different contractions to occur in the sheet 12, and thereby improve fluffing. The elastics 20, including elastic strands 20 may be oriented in any of, or combination of, the transverse, diagonal and/or longitudinal directions, to thereby provide contraction in such directions. In one embodiment the elastics 20 may be oriented at ±45 degrees relative to the longitudinal axis L.

Referring back to FIG. 2, additionally or alternatively, in yet another embodiment, the elastic sheet 12 may be made partially, mostly or entirely of the elastic material, as occurs when using an elastic 20, or elastomeric panel 20. Such an elastic panel 20 may be unilaterally or bilaterally contracted to provide rugosities 21 in the sheet 12 and thereby provide fluffing. This arrangement eliminates the need to attach a separate elastic strand 20 or elastic strip 20 to the sheet 12, as such a sheet 12 is inherently elastic. If desired, a zero strain elastic may be utilized, as disclosed in commonly assigned U.S. Pat. No. 5,143,679, issued Sep. 1, 1992.

The elastics 20 may be joined to the sheet 12, to the layer of tow fibers 14 or to both by any of several ways known in the art. For example the elastics 20 may be ultrasonically bonded, heat bonded, and/or pressure sealed using a variety of bonding patterns and/or adhesively bonded to a particular component of the cleaning article 10.

In particular embodiments of the invention the elastics 20 may include a carrier sheet to which elastic strands 20 are attached as grouped set of elastics 20 composed of a plurality of individual elastic strands. The elastic strands 20 may intersect, be interconnected or be entirely separated from each other. The carrier sheet may, for example, include a 0.05 mm thick polymer film such as a film of polypropylene sheet 12 material or a non-woven sheet 12 material. In one particular non-limiting embodiment of the invention, 2 to 20 strands may be used with each such elasticized sheet 12.

In an alternative embodiment the sheet 12 may be preconstructed using elastomeric polymer films and/or elastomeric polymers embedded into non-wovens. Suitable examples of such films include elastic materials supplied by Tredegar, of Richmond Va., under the names Flex Feel™, Flex Aire™, Extra Flex™ and Fabri Flex™. Kraton Polymers LLC of Houston, Tex., offers a series of polymers which can be formed into non-woven fabrics to create elastic properties. Suitable polymers are sold under the codes MD6717, MD6705 and G1643.

Referring again to FIG. 3, in yet another alternative embodiment the elastomeric sheets 12 of the cleaning article 10 may be heat shrinkable. Suitable heat shrinkable and/or energy activateable materials could include films such as Vistamaxx™ from ExxonMobil of Irving, Tex.

The heat shrinkable embodiment provides the advantage of incorporating such material during manufacture, then later applying heat to cause the cleaning article 10 to pucker. Such pucker may improve fluffing and resiliency. The heat source may be microwave energy, ultrasonic energy, etc.

The heat may be applied to cleaning article 10 before it is placed in the packaging. Alternatively a cleaning article 10 may be placed into a package in flat format, and the package sealed. The sealed package may be heated to activate the elastomeric components within the cleaning articles 10 while still in the package. This arrangement provides the advantage of ease of packing in flat form, while contraction and/or puckering within the in box may yield a pre-fluffed format when the cleaning article 10 is removed for use.

Further, any of the embodiments described herein may optionally include any one of, any combination of, or all of: a sheet 12 and/or tow fiber layer 14 having differential overhang DO, a sheet 12 with apertures, an elastically contracted sheet 12 and/or a cleaning article 10 having an elastically contracted upstanding panel, as shown in commonly assigned P&G Cases 12382, 12383, 12384 and 12385, respectively. All such variant embodiments are described in these four aforementioned commonly assigned patent applications, all filed Mar. 9, 2012.

Any of the sheet 12 and/or layer of tow fibers 14 may be completely or partially coated with adhesive, wax, Newtonian or non-Newtonian oils or a combination thereof, in order to improve cleaning and increase retention of absorbed debris. If desired, the cleaning article 10 may optionally be used with a cleaning solution or other solution usable for other purposes such as treating the surface for appearance or disinfectant, etc. The cleaning solution may be pre-applied to the cleaning article 10, creating a pre-moistened cleaning article 10 or may be contained within a separate reservoir for dosing onto the cleaning article 10 and/or target surface. The cleaning solution may comprise a majority water, and at least about 0.5, 2, 5 or 10% solids, or at least about 30% or 50% aqueous solvents, non-aqueous solutions or mixtures thereof (all by weight).

Optionally the cleaning article 10 may further comprise a non-planar structure, as disclosed in commonly assigned US publication 2011/0131746 A1, filed Dec. 4, 2009. The non-planar structure may extend out of the XY plane, in the z-direction.

Referring back to FIG. 1, the cleaning article 10 may optionally further comprise gather strips, as known from the prior art. As used herein, gather strips refer to cantilevered elements extending laterally outwardly from the longitudinal centerline of the article 10, and having a length (taken in the transverse direction) greater than the corresponding width (as taken in the longitudinal direction). The gather strips lie within the XY plane as intended by manufacture, although may be deformed out of the XY plane due to fluffing before use, and/or deformations which occur in use due to movement against the target surface. The gather strips may be incorporated into one of the sheets 12 described above or may be deployed on a separate sheet 12.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A cleaning article for removable attachment to a handle and having a longitudinal axis, said cleaning article comprising:

at least one layer of tow fibers, said tow fibers extending laterally outward from proximal ends juxtaposed with said longitudinal axis to distal ends laterally remote therefrom, said at least one layer further having first and second opposed faces and defining a tow fiber width across said longitudinal axis between said distal ends of said fibers; and a generally planar sheet disposed on said first face of said at least one layer of tow fibers, said sheet having first and second opposed longitudinal edges defining a sheet width therebetween, said sheet being elastically contracted at at least one discrete location cooperating with a longitudinal edge to have a sheet width predominantly less than said tow fiber width, wherein said distal ends of said tow fibers overhang the edges of said sheet providing a tow fiber overhang, the amount of said overhang varying along at least a portion of the longitudinal axis; and said cleaning article optionally comprising laterally extending gather strips.

2. A cleaning article according to claim 1 wherein said sheet is elastically contracted to different sheet widths, whereby the difference in width between said sheet and said tow fibers varies along said a predominant portion of said longitudinal length.

3. A cleaning article according to claim 2 wherein said generally planar sheet comprises a first sheet and further comprising a second sheet joined to said first sheet to form at least one longitudinally oriented sleeve therebetween for receiving a fork tine therein, said cleaning article further comprising a longitudinally oriented handle, said handle having a grip and at least one tine joined thereto, said at least one tine being removably inserted to said at least one longitudinally oriented sleeve so that said cleaning article can be manipulated by a user holding said grip.

4. A cleaning article according to claim 3 having a proximal edge proximate to said grip and a distal edge longitudinally opposed thereto, said first sheet and said second sheet both being elastically contracted to have a sheet width predominantly less than said tow fiber width, wherein said distal ends of said tow fibers overhang the edges of said sheet a greater amount near said distal edge than near said proximal edge.

5. A cleaning article according to claim 3 wherein said first sheet is joined to said tow fibers and said second sheet is outwardly facing, said second sheet having a lesser longitudinal length than said first sheet, said first sheet and said second sheet both being elastically contracted to have a respective sheet width predominantly less than said tow fiber width, wherein said distal ends of said tow fibers overhang the edges of both said sheets.

6. A cleaning article according to claim 5 wherein said first sheet and said second sheet are elastically contracted to have a respective sheet width predominantly less than said tow fiber width throughout said entire longitudinal length of said second sheet.

7. A cleaning article according to claim 6 wherein at least one of said first sheet and said second have a respective non-constant sheet width.

8. A cleaning article according to claim 7 having a transverse axis, said non-constant sheet width being less as said transverse axis approached.

9. A cleaning article according to claim 1 wherein said elastic sheet comprises a heat shrinkable material.

10. A cleaning article according to claim 9 further comprising a package for enclosing said cleaning article, and made according to the process of inserting said cleaning article into said package, then applying heat thereto, to cause contraction of said heat shrinkable material while inside said package.

11. A cleaning article for removable attachment to a handle and having a longitudinal axis, said cleaning article comprising:

at least one layer of tow fibers, said tow fibers extending laterally outward from proximal ends juxtaposed with said longitudinal axis to distal ends laterally remote therefrom, said at least one layer further having first and second opposed faces and defining a tow fiber width across said longitudinal axis between said distal ends of said fibers; and a generally planar sheet disposed on said first face of said at least one layer of tow fibers, said sheet having first and second opposed longitudinal edges defining a sheet width therebetween, said sheet having at least one elastic strand joined thereto, so that said sheet is elastically contracted at at least one discrete location cooperating with at least one said longitudinal edge to have a sheet width predominantly less than said tow fiber width, wherein said distal ends of said tow fibers overhang the edges of said sheet providing a tow fiber overhang, the amount of said overhang varying along at least a portion of the longitudinal axis.

12. A cleaning article according to claim 11 wherein said generally planar sheet comprises a first sheet; and further comprising a second sheet joined to said first sheet to form at least one longitudinally oriented sleeve therebetween for receiving a fork tine;

said article further comprising at least one elastic strand disposed intermediate said first sheet and said second sheet, said at least one elastic strand being adhesively joined to at least one of said first sheet and said second sheet.

13. A cleaning article according to claim 12 comprising a single elastic strand, said single elastic strand being disposed in a generally longitudinally oriented sinusoidal pattern crossing said longitudinal axis.

14. A cleaning article according to claim 11 comprising a plurality of elastic stands, each of said elastic stands contracting said sheet in the transverse direction.

15. A cleaning article according to claim 14 comprising at least a first elastic strand and a second elastic strand, wherein said first and said second elastic strands have mutually different spring rates.

16. A cleaning article according to claim 11 comprising a plurality of elastic strands, at least some of said elastic strands of said plurality being oriented in mutually different directions, wherein said plurality of strands provides contraction in said longitudinal direction and said transverse direction.

17. A cleaning article according to claim 16 comprising at least two elastic strands oriented generally mutually perpendicular to each other, each said elastic strand being oriented generally at 45 degrees with respect to said longitudinal axis.

18. A cleaning article for removable attachment to a handle and having a longitudinal axis, said cleaning article comprising:

at least one layer of tow fibers, said tow fibers extending laterally outward from proximal ends juxtaposed with said longitudinal axis to distal ends laterally remote therefrom, said at least one layer further having first and second opposed faces and defining a tow fiber width across said longitudinal axis between said distal ends of said fibers; and an elastic generally planar sheet disposed on said first face of said at least one layer of tow fibers, said sheet having first and second opposed longitudinal edges defining a sheet width therebetween, said sheet being elastically contracted at at least one discrete location cooperating with at least one said longitudinal edge to have a sheet width predominantly less than said tow fiber width, wherein said distal ends of said tow fibers overhang the edges of said sheet providing a tow fiber overhang, the amount of said overhang varying along at least a portion of the longitudinal axis.

19. A cleaning article according to claim 18 wherein said elastic sheet has bilateral contraction, so that said sheet is elastically contracted in the longitudinal direction and in the transverse direction.

20. A cleaning article according to claim 18 having a transverse direction perpendicular to said longitudinal axis, wherein said generally planar sheet comprises a first sheet; and further comprising a second sheet joined to said first sheet to form at least one longitudinally oriented sleeve therebetween for receiving a fork tine, each of said first sheet and said second sheet being elastically contracted in the transverse direction, and first sheet having more contraction than said second sheet.

* * * * *